United States Patent [19]

Borne et al.

[11] Patent Number: 4,561,712

[45] Date of Patent: Dec. 31, 1985

[54] VERSATILE ELECTRIC CONNECTOR

[75] Inventors: André Borne, Villeurbanne; Jean-Paul Heng, Lyons, both of France

[73] Assignee: CGEE ALSTHOM, Levallois-Perret, France

[21] Appl. No.: 469,604

[22] Filed: Feb. 24, 1983

[30] Foreign Application Priority Data

Feb. 24, 1982 [FR] France ..... 82 03037

[51] Int. Cl.[4] ..... H01R 27/00; H01R 4/24; H01R 13/11

[52] U.S. Cl. ..... 339/33; 339/97 P; 339/256 R; 339/258 F

[58] Field of Search ..... 339/97 R, 97 P, 98, 339/99 R, 258 P, 256 R, 258 R, 32 R, 33, 256 SP, 258 F, 258 S

[56] References Cited

U.S. PATENT DOCUMENTS

| | | | |
|---|---|---|---|
| 2,969,521 | 1/1961 | Scoville | 339/32 R X |
| 3,097,906 | 7/1963 | Shannon | 339/258 F |
| 3,192,498 | 6/1965 | Ruehlemann | 339/33 |
| 3,860,318 | 1/1975 | Reavis, Jr. et al. | 339/99 R |
| 4,066,316 | 1/1978 | Rollings | 339/97 R X |
| 4,241,970 | 12/1980 | Rider et al. | 339/99 R |

FOREIGN PATENT DOCUMENTS

| | | | |
|---|---|---|---|
| 1465609 | 9/1969 | Fed. Rep. of Germany | 339/258 P |
| 1268793 | 6/1961 | France . | |
| 2320643 | 3/1977 | France . | |
| 908785 | 10/1962 | United Kingdom . | |
| 1434003 | 4/1976 | United Kingdom | 339/98 |
| 32385/75 | 7/1976 | United Kingdom . | |

*Primary Examiner*—Gil Weidenfeld
*Assistant Examiner*—Steven C. Bishop
*Attorney, Agent, or Firm*—Sughrue, Mion, Zinn, Macpeak & Seas

[57] ABSTRACT

A versatile electric connector with an automatic stripper and additional gripping means. The electric connector (1) has at least one automatic stripper (2) associated with a gripping means (5) with paired lyre-shaped parts (5L, 5L') the bases of the two lyre-shaped parts of a pair (5LA, 5L'A) being parallel and face to face so as to allow a extra connection to be set up in any one of three perpendicular directions at the lyre-shaped parts.

5 Claims, 5 Drawing Figures

VERSATILE ELECTRIC CONNECTOR

The present invention relates to a versatile electric connector and in particular to a connector comprising an automatic wire stripping portion together with an additional connector portion.

BACKGROUND OF THE INVENTION

Electric connectors for automatically stripping electric wires currently form a part of numerous connector units, and in particular of numerous kinds of connector block. They have the advantage of enabling rapid, simple and reliable connection to insulated wire compared to the connection previously provided by earlier means such as nut and bolt connections.

Connectors are intended to provide electric connection either between a pair of wires or between a single wire and some kind of electric equipment; thus a wire stripping connector includes at least one insulation displacement connector and at least one other connector part adapted to some specific need to be satisfied. The other connector part may be a second insulation displacement connector, or else it may be some other kind of connector.

Now, in numerous connectors, the user wishes to have access to the electric connections set up by means of the connector in order, for example, to form jumper connections or distribution systems or to be able to temporarily disconnect the connection or even to be able to perform continuity tests.

These kinds of operation can sometimes be carried out at various points of an installation but it is often very practical to be able to carry them out on the connectors which are generally more accessible than the rest of the equipment. Further, said connectors are usually grouped together at locations suitable for facilitating modifications, taking out of service, etc.

Specialized additional connector means are therefore provided on the wire-stripping connectors mentioned hereinabove so as to satisfy specific needs. However, it is clear that it is not possible to at manufacture at reasonable expense all the possible combinations of connection parts which include some kind of automatic wire stripper part together with another connector part.

The present invention therefore aims to produce a versatile electric connector which enables various kinds of connection to be made and in particular connections to parts oriented in different directions, but all by means of the same type of connector part.

SUMMARY OF THE INVENTION

The present invention provides a versatile electric connector having:

at least one insulation displacement connector part in the form of a metal component which is a good conductor of electricity, which is resilient and which has a slot for gripping wire, which slot has a flared opening for stripping insulation from a wire, the edges of said opening being sharpened so as to cut the insulation of a wire which is to be connected before said wire is fully inserted in said slot, and at least one additional contact part formed by an extension of said metal component which constitutes the insulation displacement connector, said additional contact part comprising a pair of lyre-shaped contactors whose bases are parallel and face to face to allow an additional connection to be set up with said contact arms of said lyre-shaped parts, said additional connection being made in any one of three perpendicular directions.

BRIEF DESCRIPTION OF THE DRAWINGS

Other features and advantages of the present invention are discussed in the following description with reference to the accompanying drawings, in which.

MORE DETAILED DESCRIPTION

Figure 1:
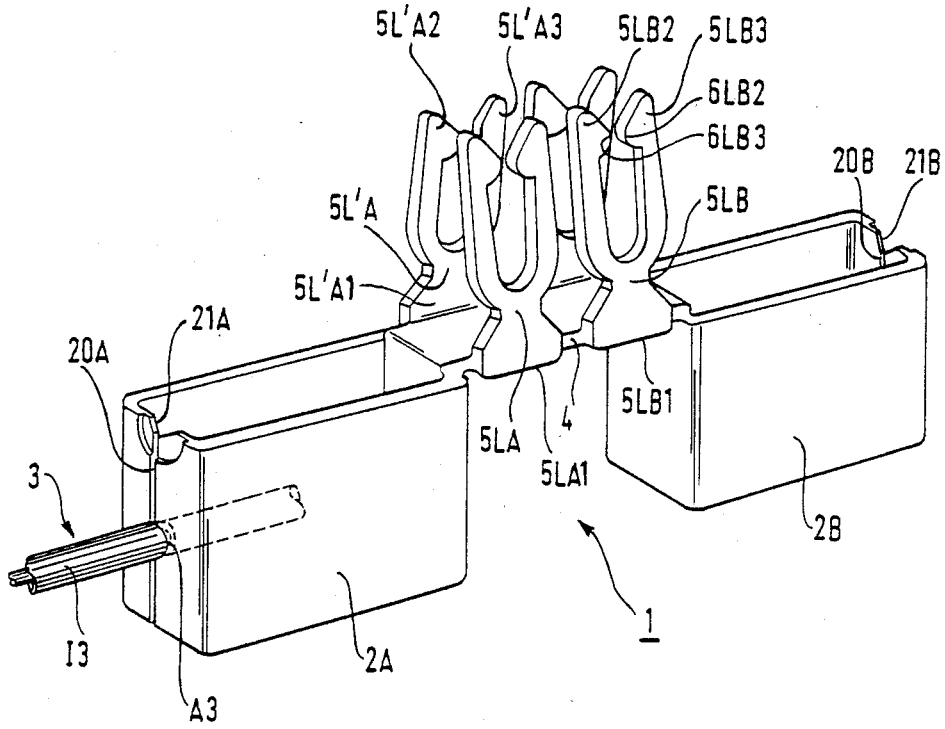
FIG. 1 is a perspective view of a first example of an electric connector in accordance with the invention, said first example being referred to herein as a double connector.

FIG. 1 shows a connector 1 in accordance with the invention of a kind referred to below as a "double connector".

Said double connector is made up of two parts which are symmetrical about a mid plane which separates them. Two single connectors can be obtained simply by cutting a double connector along its mid plane. Therefore, the same manufacturing means can be used to produce either a double connector or else two symmetrical and—in the present case—identical parts.

The double connector is preferably made from a sheet of metal which is a good conductor and which is very resilient; said metal sheet is cut and folded in conventional manner to obtain the required shape.

The connector 1 has at least one component 2, i.e. 2A or 2B with a slot 20, i.e. 20A or 20B for gripping the core A3 of a wire 3 which is to be connected. Each slot 20 has a flared opening 21, i.e. 21A or 21B which is used to strip the insulation off the wires to be connected, i.e. insulation I3 on wire 3.

Conventionally, the edges of the flared openings are partially sharpened so as to cut the insulation without damaging the core during connection as each wire is pushed into a slot via the flared opening thereof.

The connector 1 also has an extension 4 projecting from automatic wire-stripping portion or, more precisely, from the component 2. The extension 4 carries at least one pair of lyre-shaped parts 5L, 5L' such as 5LA, 5L'A and preferably has two pairs 5LA, 5L'A and 5LB, 5L'B in the case of a double connector.

Each lyre-shaped part conventionally has a base such as 5LA1 or 5LB1 and two arms such as 5L'A2 and 5L'A3 for the lyre-shaped part 5L'A or 5LB2 and 5LB3 for the lyre-shaped part 5LB. Each of the arms of a lyre-shaped part has a bulge 6LB such as the bulges 6LB1 and 6LB2 which face each other so as to bear against any component of suitable thickness inserted between them.

Figure 5:
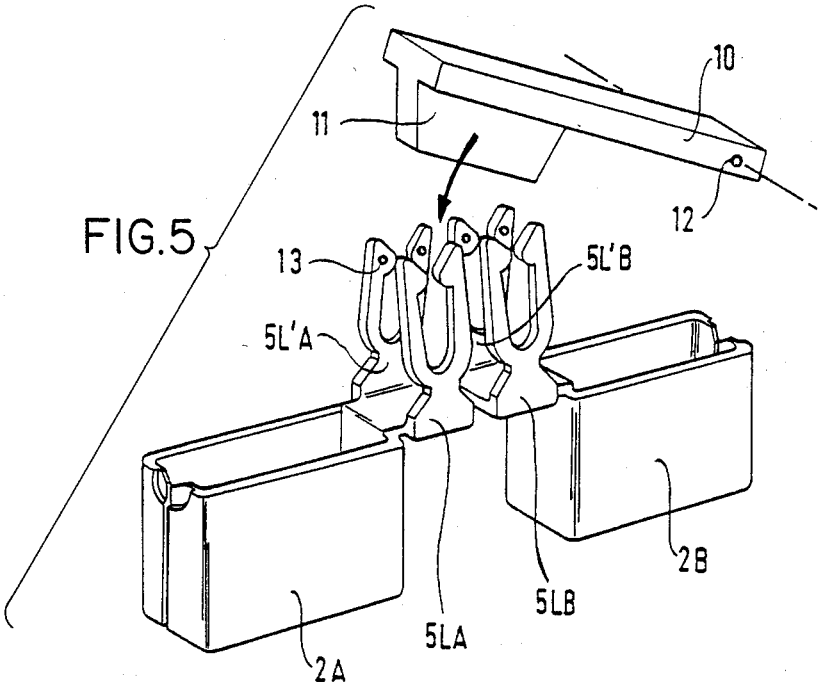
FIG. 5 is a perspective view showing how two single connectors can be used together with connection being in a direction at right angles both to FIG. 2 and to FIG. 3.

Likewise, similar bulges such as 13 may optionally be provided for the same purpose on the facing surfaces of the arms of the two lyre-shaped parts of a pair such as 5LA and 5L'A (FIG. 5).

The bases of the two lyre-shaped parts of each pair are parallel and face to face as are the bases 5LA1 and 5L'A1 (FIG. 1) and the arms are inclined at identical angles towards each other so that the arms bear identically on any cylindrical component of suitable diameter which is inserted between them.

The four arms of a pair of lyre-shaped parts such as 5LA and 5L'A substantially define a square whose diagonals correspond roughly to the diameter of the cylindrical component which can be inserted between them.

The connector 1 is cut out from a plane metal strip and is then bent the shapes of the parts intended to constitute the automatic stripers 2, the extension 4 and the lyre-shaped parts depending on the shape of the connector as cut out. A succession of folding operations carried out at both ends of each cut out plane part makes it possible to constitute two rectangular parallelepipeds 2A, 2B each having two parallel surfaces which are open and connected together by the extension 4 so that the lyre-shaped parts which are also positioned by folding are disposed in succession between the rectangular parallelepipeds 2A, 2B, and preferably on the other side of the plane of the extension 4.

Preferably, the slots 20 and the flared openings 21 are provided in the short sides of the rectangular parallelepipeds which are on the outside of the connector 1 whereas the extension 4 projects from the tops of the short sides of the rectangular parallelepipeds which are inside the connector 1.

Depending on requirements, the connector 1 can be used such as it is or else it can be separated into two symmetrical or asymmetrical halves by cutting the extension 4 between the pairs of lyre-shaped parts, or to one side thereof.

In a usual way, the connector is accommodated in a housing made of an insulating substance which usually allows it to be fixed to and combined with identical or compatible parts.

As briefly set forth hereinabove, the connector makes it possible to make connections in three different directions using the lyre-shaped parts in addition to the connections made by automatic wire stripping.

Figure 2:
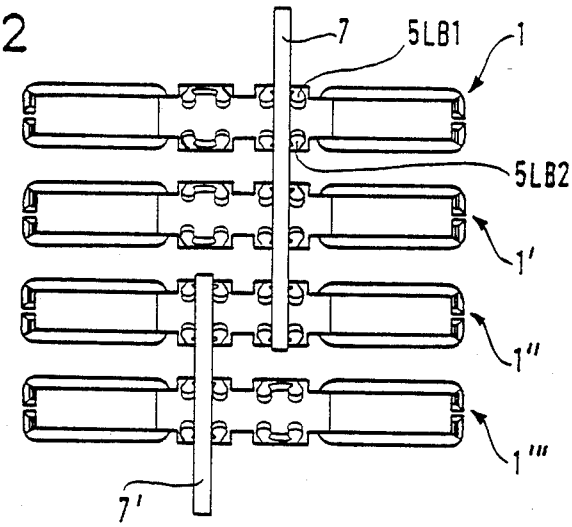
FIG. 2 is a plan view of an example of an assembly of double connectors as shown in FIG. 1 the connectors being interconnected in a direction perpendicular to their lyres.

In particular, FIG. 2 shows how it is possible to interconnect a plurality of connectors 1, 1', 1'', 1''', in accordance with the invention by means of conductor bar such as 7 and 7' inserted between the arms of the lyre-shaped parts such as 5LB1, 5LB2 perpendicularly to these lyre-shaped parts, each bar being slightly wider than the minimum distance between the arms of the same lyre-shaped part at the bulges 6LB (FIG. 1) so as to be gripped therebetween while preferably bearing against the bottom of the fork of a lyre-shaped part.

In particular, it is possible to provide for distribution along a length exceeding that of a bar by using one or more connectors to ensure connection between successive bars, i.e. the connector 1'' between the bars 7 and 7'.

Figure 3:
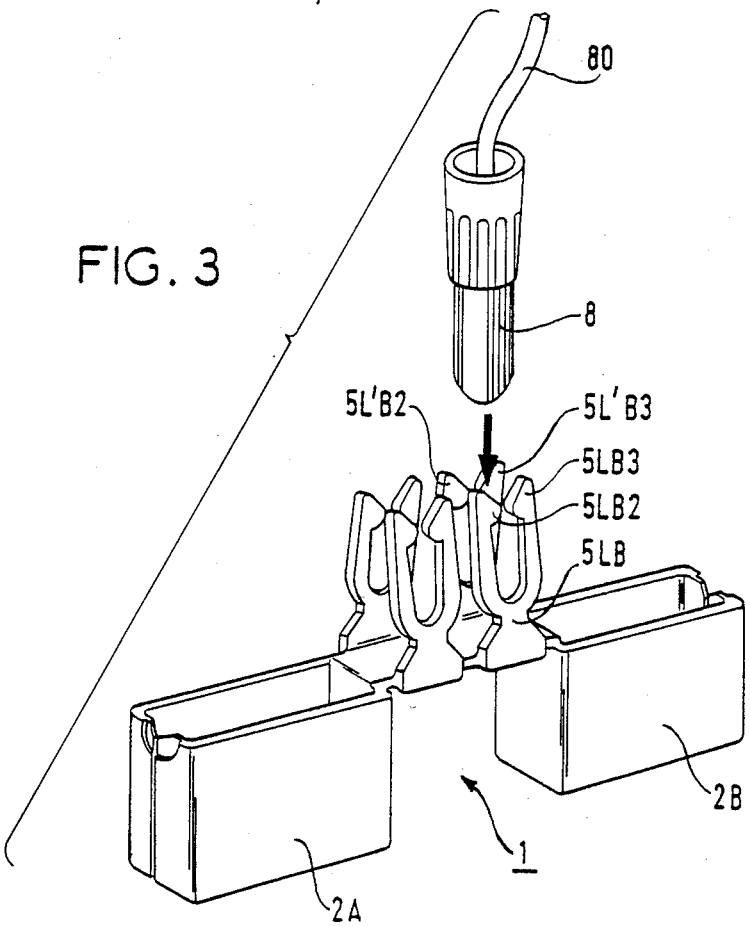
FIG. 3 is a perspective view showing how a connector in accordance with the invention is used in a direction at right angles to that shown in FIG. 2.

FIG. 3 shows how it is possible to connect a cylindrical male pin 8 having a lead 80 to a connector 1 e.g. during an experiment, by choosing a pin whose diameter is slightly greater than the distance between two diagonally opposite arms of a pair of lyre-shaped parts.

With this aim in view, the conductor part 8 is fitted into the space between the inclined arms of a pair of lyre-shaped parts such as the arms 5LB2, 5LB3, 5L'B2, 5L'B3 in such a way that said conductor part is held in place by the resilient return force which urges these arms towards their initial positions from which they are displaced in pairs.

Figure 4:
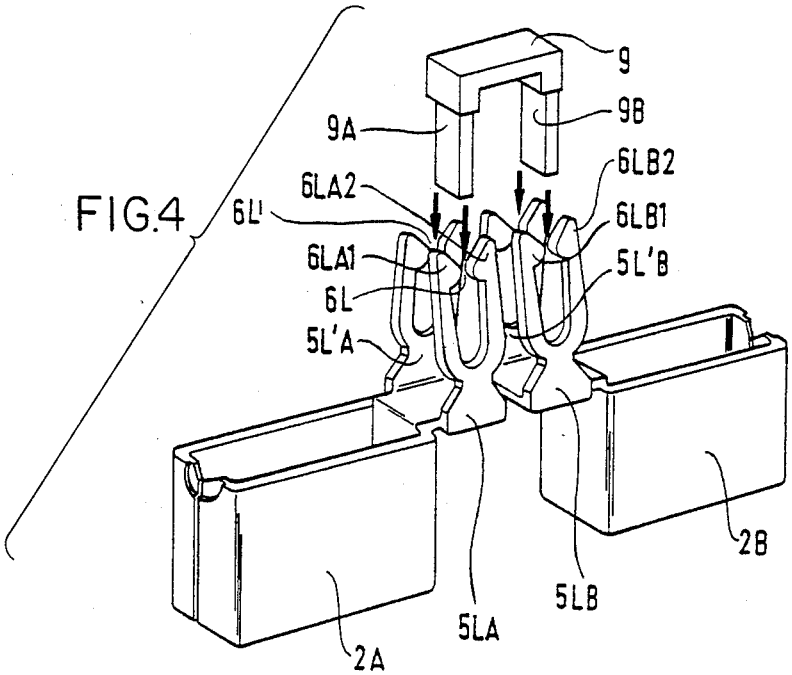
FIG. 4 is a perspective view showing how two single connectors in accordance with the invention can be used together, connection being in the same direction as in FIG. 3.

Of course, such an axial connection can be envisaged both in the case of the double connector illustrated here and in the case of a single connector comprising just one half such as the half 2A (see also FIG. 4).

FIG. 4 shows how it is possible to interconnect two single connectors 2A and 2B obtained by cutting a connector 1 along its plane of symmetry between two groups of lyre-shaped parts 5LA, 5L'A and 5LB, 5L'B to form a connection which can be disconnected at will.

With the above aim in view, a detachable strip plate 9 is used which has two interconnected contact blades 9A, 9B each of which is slightly thicker than the minimum distance between the arms of the same lyre-shaped part at the bulges and a length equal to or slightly greater than the distance between the two adjacent lyre-shaped parts of the same single connector. Assuming that the two single connection parts 2A and 2B are contained with their lyre-shaped parts in a connector housing in which they are held, it is possible to make or break at will a connection between two parts 2A and 2B by inserting the contact blades 9A and 9B between the two arms of the respective lyre-shaped parts of each connector or by removing them therefrom, the bulges 6L, 6L' of said arms pressing resiliently against said blades.

FIG. 5 shows another way of interconnecting two single connectors 2A and 2B using their lyre-shaped parts and a knife which has an insulator body 10, a contact blade 11, and is installed on a shaft 12 integral with the housing (not illustrated).

The knife is set parallel to the bases of the lyre-shaped parts so that rotating the knife causes the contact blade 11 to be inserted between the lyre-shaped parts 5LA and 5L'A and the part 2A and between the lyre-shaped parts 5LB and 5L'B of the part 2B which are assumed to be aligned by their common housing.

The contacts are then made parallel to the bases of the lyre-shaped parts, with the two arms of each lyre-shaped part remaining parallel when moved apart from each other and moving an identical distance outward from their initial positions under the effect of the blade 11.

We claim:

1. A versatile electric connector comprising:

at least one insulation displacement connector part in the form of a metal component which is a good conductor of electricity, said component being resilient and having a slot for gripping wire, said slot having a flared opening for stripping insulation from a wire inserted therein, the edges of said opening being sharpened so as to cut through the insulation of a wire which is to be connected before said wire is fully inserted in said slot; and at least one additional contact part formed by an integral extension of said metal component, said additional contact part comprising a pair of lyre-shaped gripping parts having bases parallel to each other and face to face and having spaced contact arms extending from said bases, and wherein said contact arms of facing lyre-shaped gripping parts are bent towards each other from the base outwardly such that conductor bars may be inserted between the spaced contact arms of a given lyre-shaped gripping part, a cylindrical pin or a diameter slightly larger than the distance between two diagonally opposite arms of a pair of lyre-shaped gripping parts may be inserted between said pair of lyre-shaped gripping parts or a knife contact blade may be inserted parallel to the bases of the pair of lyre-shaped gripping parts and between the same, thereby allowing connections to be set up with said contact arms of said lyre-shaped gripping parts in any one of three perpendicular directions.

2. An electric connector according to claim 1, wherein said connector part is formed of a cut and folded plane metal sheet having at least one rectangular parallelepiped shaped portion bearing said insulation displacing slot opening in one of its short sides, said opening bring on an open face of said rectangular parallelepiped shaped portion, and wherein the extension which carries lyre-shaped gripping parts projects from the other short side of the component and extends parallel to said open face.

3. An electric connector according to claim 1, wherein the extension which carries the lyre-shaped gripping parts is located on the same open face of the rectangular parallelepiped shaped portion as the flared stripper opening of said component.

4. An electric connector according to claim 2, wherein the lyre-shaped gripping parts and all rectangular parallelepiped shaped portions are located on either side of the plane defined by the extension which carries said lyre-shaped gripping parts.

5. An electric connector according to claim 1, wherein two automatic stripper parts are disposed symmetrically and interconnected by a double gripping part which has two pairs of parallel lyre-shaped parts disposed in succession between the two automatic stripper parts on the same extension.

* * * * *